US006413143B1

(12) United States Patent
Lu

(10) Patent No.: US 6,413,143 B1
(45) Date of Patent: Jul. 2, 2002

(54) DUAL-GEARSHIFT POSITION TRANSMISSION MECHANISM FOR REMOTE CONTROL TOY CAR

(76) Inventor: Ke-Way Lu, 3F, No. 322, Sec. 6, Min-Chaun E. Rd., Taipei City (TW)

( * ) Notice: Subject to any disclaimer, the term of this patent is extended or adjusted under 35 U.S.C. 154(b) by 0 days.

(21) Appl. No.: 09/821,306

(22) Filed: Mar. 29, 2001

(51) Int. Cl.[7] ..... A63H 30/00

(52) U.S. Cl. ..... 446/454; 446/457; 446/461; 74/336 R; 192/48.6

(58) Field of Search ..... 446/454, 431, 446/457, 461, 448, 236; 74/336 R, 333; 192/48.6, 48.92, 105 CD

(56) References Cited

U.S. PATENT DOCUMENTS 4,377,918 A * 3/1983 Zbriger ..... 446/444
4,457,185 A * 7/1984 Yoshida et al. ..... 192/105 B
5,000,057 A * 3/1991 Tseng ..... 192/48.92
5,186,693 A * 2/1993 Nishida et al. ..... 192/48.92

* cited by examiner

*Primary Examiner*—Jacob K. Ackun
*Assistant Examiner*—Bera B. Miller
(74) *Attorney, Agent, or Firm*—Ladas & Parry

(57) ABSTRACT

A dual-gearshift position transmission mechanism for remote control toy car includes an output shaft, a first transmission gear and a second transmission gear mounted on the output shaft, a two-way axle bearing supporting the output shaft in the first transmission gear, an one-way axle bearing supporting the output shaft in the second transmission gear, a clutch fixedly fastened to the output shaft, an idle gear wheel meshed between the first transmission gear and the second transmission gear, a driven gear coupled to the first transmission gear, a drive gear meshed with the driven gear, and an engine controlled to rotate the drive gear.

2 Claims, 3 Drawing Sheets

DUAL-GEARSHIFT POSITION TRANSMISSION MECHANISM FOR REMOTE CONTROL TOY CAR

BACKGROUND OF THE INVENTION

The present invention relates to a remote control toy car and, more particularly, to a dual-gearshift position transmission mechanism for remote control toy car, which provides two transmission modes, has a compact structure, and is inexpensive to manufacture.

In a regular gasoline engine remote control toy car, a transmission mechanism is used to transmit the driving power of the engine to the front wheel system and the rear wheel system. The transmission mechanism of conventional gasoline engine remote control toy cars provides only one transmission mode, it is less efficient to accelerate the speed, and the torsion cannot be increased during low speed. In order to eliminate these problems, dual-gearshift position transmission mechanisms are developed. However, these prior art dual-gearshift position transmission mechanisms are commonly heavy, complicated, and expensive. Furthermore, the parts of these high-precision dual-gearshift position transmission mechanisms wear quickly with use.

SUMMARY OF THE INVENTION

The present invention has been accomplished to provide a dual-gearshift position transmission mechanism, which eliminates the aforesaid drawbacks. It is one object of the present invention to provide a dual-gearshift position transmission mechanism, which provides to transmission modes to improve the torsion when accelerating the speed or reducing it. It is another object of the present invention to provide a dual-gearshift position transmission mechanism, which has a simple structure. It is still another object of the present invention to provide a dual-gearshift position transmission mechanism, which requires less installation space. It is still another object of the present invention to provide a dual-gearshift position transmission mechanism, which is durable in use. It is still another object of the present invention to provide a dual-gearshift position transmission mechanism, which is inexpensive to manufacture. To achieve these and other objects of the present invention. the dual-gearshift position transmission mechanism comprises an output shaft, a first transmission gear mounted on the output shaft, the first transmission gear having a protruded block in a recessed front side thereof, a second transmission gear mounted on the output shaft, a two-way axle bearing mounted in the first transmission gear to support the output shaft in the first transmission gear, an one-way axle bearing mounted in the second transmission bear to support the output shaft in the second transmission gear, a clutch fixedly fastened to the output shaft and disposed in the recessed front side of the first transmission gear, an idle gear wheel, the idle gear wheel having a first gear meshed with the first transmission gear and a second gear meshed with the second transmission gear, a driven gear coupled to the first transmission gear, a drive gear meshed with the driven gear, and an engine controlled to rotate the drive gear, wherein when starting the engine, the drive gear is driven by the engine to rotate the driven gear and then the first transmission gear, causing the idle gear wheel to be rotated with the first transmission gear to rotate the output shaft through the second transmission gear and the one-way gear wheel; when the speed of revolution of the output shaft reaches a predetermined level, the clutch is forced by a centrifugal into engagement with the protruded block of the first transmission gear, for enabling the driving power of the engine to be directly transmitted through the drive gear, the driven gear, and the first transmission gear to the output shaft; when the speed of revolution of the output shaft drops below the predetermined level, the clutch is disengaged from the protruded block of the first transmission gear for enabling the driving power of the engine to be transmitted through the drive gear, the driven gear, the first transmission gear, the idle gear wheel, the second transmission gear, and the one-way axle bearing to the output shaft.

DETAILED DESCRIPTION OF THE PREFERRED EMBODIMENT

Figure 1:
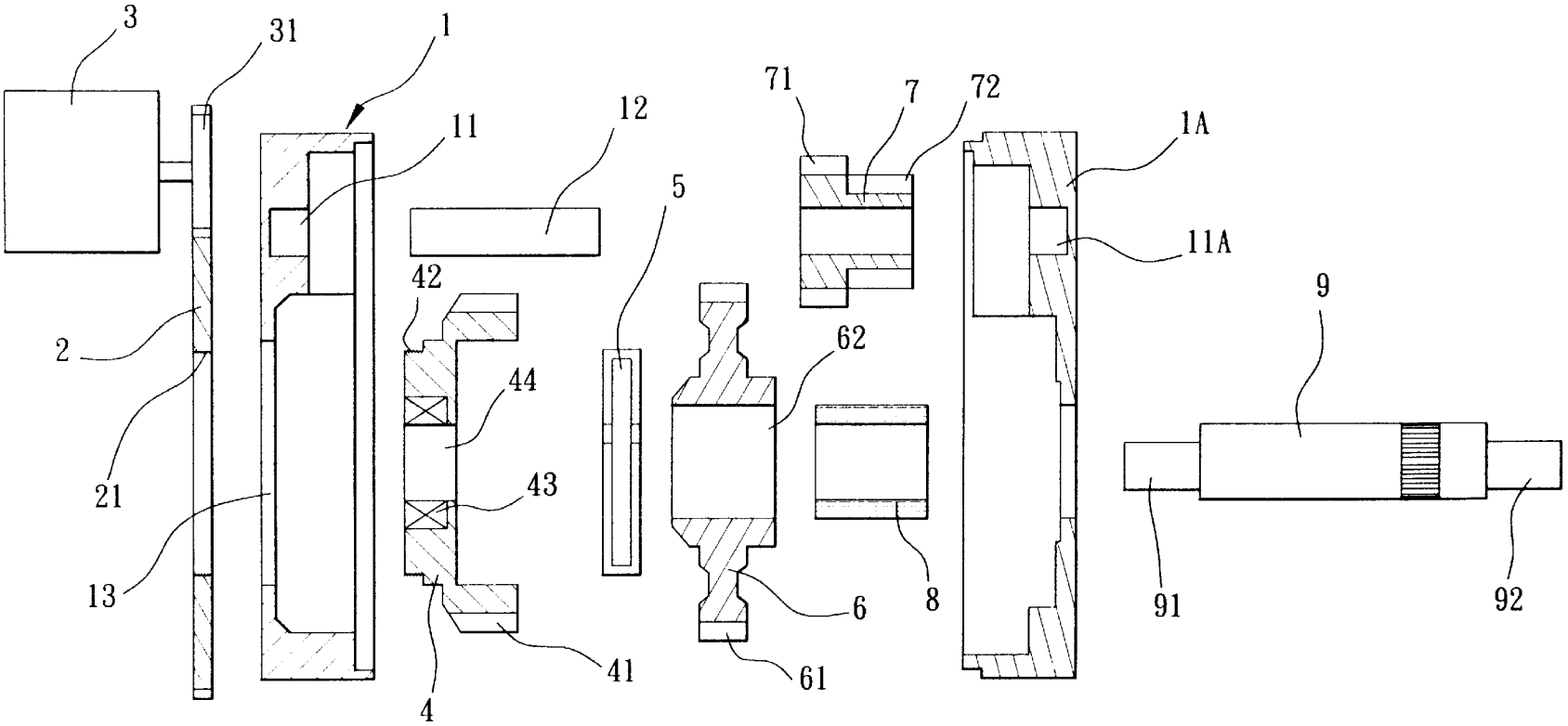
FIG. 1 is an exploded plain view of a dual-gearshift position transmission mechanism for remote control toy car according to the present invention.

Referring to FIG. 1, a dual-gearshift position transmission mechanism for remote control toy car in accordance with the present invention is generally comprised of a housing formed of a casing 1 and a cover shell 1A, an engine 31, a drive gear 31 coupled to the engine 3, a driven gear 2, a first transmission gear 4, a clutch 5, a second transmission gear 6, an idle gear wheel 7, an one-way axle bearing 8, and an output shaft 9.

Figure 2:
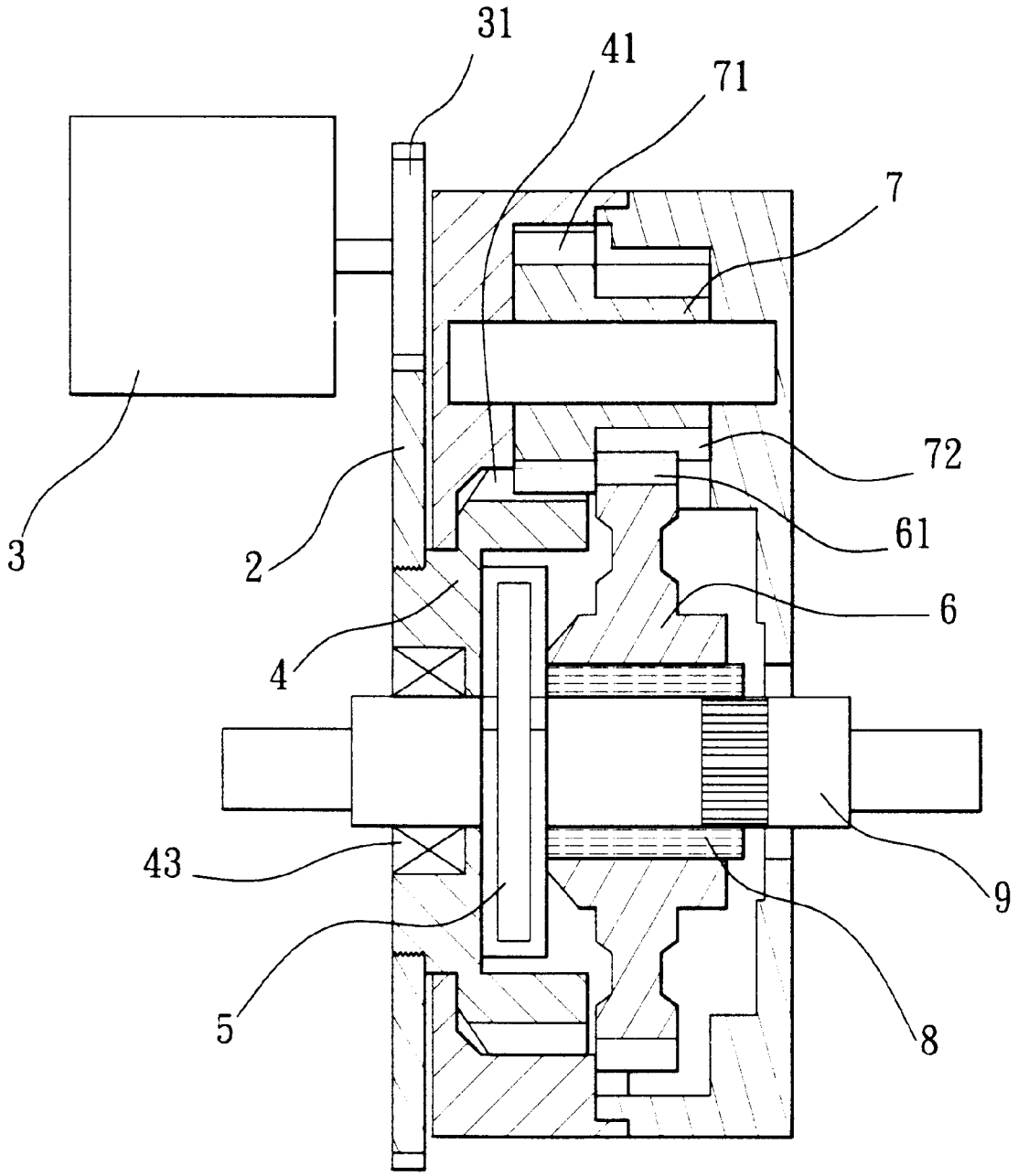
FIG. 2 is an assembly plain view of the dual-gearshift position transmission mechanism for remote control toy car according to the present invention.
Figure 3:
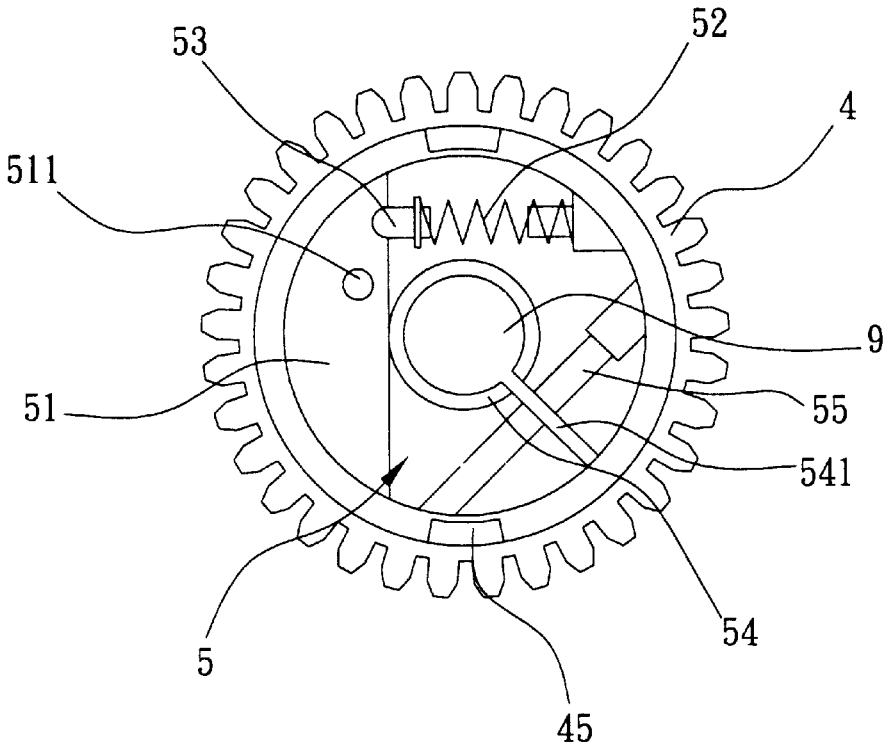
FIG. 3 is a plain view of the clutch for the dual-gearshift position transmission mechanism for remote control toy car according to the present invention.

Referring to FIGS. 2 and 3 and FIG. 1 again, the casing 1 has a bottom opening 13 and an inside recessed hole 11 disposed at one side of the bottom opening 13. The cover shell 1A is fixedly covered on the casing 1, having an inside recessed hole 11A corresponding to the inside recessed hole 11 of the casing 1. The first transmission gear 4 is mounted inside the casing 1, comprising a protruded block 45 suspended in the recessed front side thereof (see FIG. 3). a series of teeth 41 disposed around the periphery, and a short threaded shank 42 axially extended from the back side thereof, a center through hole 44 axially extended through the central axis of the short threaded shank 42, and an axle bearing 43 mounted in the center through hole 44 and adapted to rotate in reversed directions. The second transmission gear 6 is mounted in the cover shell 1A and aimed at the first transmission gear 4, comprising a series of teeth 61 disposed around the periphery and a center through hole 62 adapted to receive the one-way axle bearing 8. The output shaft 9 is inserted through the cover shell 1A, the one-way axle bearing 8 in the second transmission gear 6, the axle bearing 43 in the first transmission gear 4, having a first end 91 coupled to the front wheel system (not shown) and a second end 92 coupled to the rear wheel system (not shown). The clutch 5 is mounted in the recessed front side of the first transmission gear 4 and fixedly fastened to the output shaft 9, comprising an oscillating member 51 pivoted to the base (not shown) thereof by a pivot 511, a stop element 53 stopped against one end of the oscillating member 51, a spring 52 connected between the base and the stop element 53 to force the stop element 53 against the oscillating member 51 and to stop the oscillating member 51 from extending out of the clutch, a split clamping ring 54 disposed at the center and clamped on the output shaft 9, the split clamping ring 54 having two lugs 541 respectively extended from the two ends thereof, and a screw 55 fastened to the lugs 541 to fixedly secure the clamping ring 54 to the output shaft 9. The spring power of the spring 52 is preferably adjustable. An axle 12 is mounted in the inside recessed hole 11 of the casing 1 and the inside recessed hole 11A of the cover shell 1A to support the idle gear wheel 7 in the housing 1;1A. The idle gear wheel 7 comprises a big gear 71 meshed with the teeth 41 of the first transmission gear 4, and a small gear 72 meshed with the teeth 61 of the second transmission gear 6. The drive gear 31 is driven by the engine 3 to rotate the driven gear 2. The driven gear 2 has a center screw hole 21. After installation of the first transmission gear 4, the short threaded shank 42 is extended out of the bottom opening 13 of the casing 1 and threaded into the center screw hole 21 of the driven gear 2 for synchronous rotation with the driven gear 2.

Figure 4:
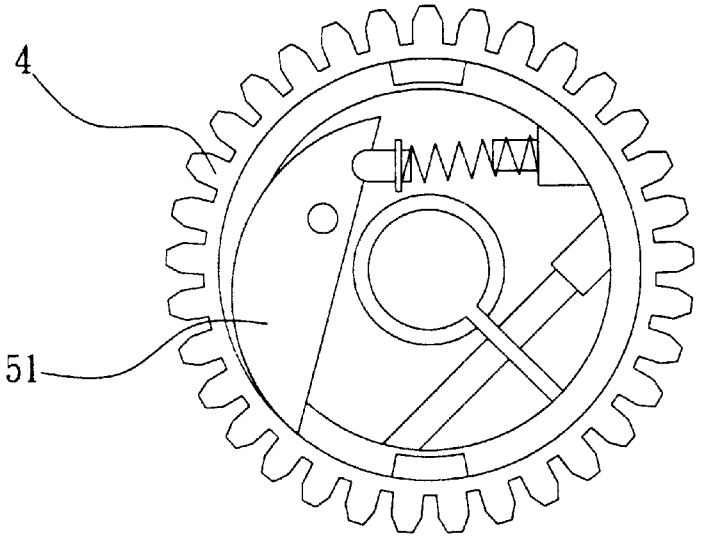
FIG. 4 illustrates the clutch of FIG. 3 operated.

Referring to FIG. 4 and FIGS. 2 and 3 again, when starting the engine 3. the drive gear 31 drives the driven gear 2 to rotate the first transmission gear 4, causing the idle gear wheel 7 to rotate the second transmission gear 6. By means of the effect of the one-way axle bearing 8, the output shaft 9 is rotated with the second transmission gear 6 at a low speed at this time. During rotary motion of the output shaft 9, the clutch is rotated synchronously. When the speed of the engine 3 surpasses a predetermined level after starting, then centrifugal force produced from the rotary motion of the clutch 5 forces the oscillating member 51 to overcome the pressure of the stop element 53 and to turn to the outside of the clutch 5 (see FIG. 4) into engagement with the protruded block 45 of the first transmission gear 4, for enabling the driving power of the engine 3 to be directly transmitted through the drive gear 31, the driven gear 2 and the first transmission gear 4 to the output shaft 9. On the contrary, when the speed of the engine 3 drops below the predetermined level, the spring 52 overcomes the centrifugal force, the oscillating member 51 is disengaged from the protruded block 45 of the first transmission gear 4, enabling the driving power of the engine 3 to be transmitted through the drive gear 31, the driven gear 2, the first transmission gear 4, the idle gear wheel 7 and the second transmission gear 6 to the output shaft 9.

A prototype of dual-gearshift position transmission mechanism for remote control toy car has been constructed with the features of FIGS. 1~4. The dual-gearshift position transmission mechanism for remote control toy car functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A dual-gearshift position transmission mechanism for remote control toy car comprising:

an output shaft;

a first transmission gear mounted on said output shaft, said first transmission gear comprising a protruded block in a recessed front side thereof;

a second transmission gear mounted on said output shaft;

a two-way axle bearing mounted in said first transmission gear to support said output shaft in said first transmission gear;

an one-way axle bearing mounted in said second transmission bear to support said output shaft in said second transmission gear;

a clutch fixedly fastened to said output shaft and disposed in the recessed front side of said first transmission gear;

an idle gear wheel, said idle gear wheel comprising a first gear meshed with said first transmission gear and a second gear meshed with said second transmission gear;

a driven gear coupled to said first transmission gear;

a driven gear meshed with said driven gear; and an engine controlled to rotate said drive gear;

wherein when starting said engine, said drive gear is driven by said engine to rotate said driven gear and then said first transmission gear, causing said idle gear wheel to be driven by said first transmission gear to rotate said output shaft through said second transmission gear and an one-way gear wheel; when the speed of revolution of said output shaft reaches a predetermined level, said clutch is forced by a centrifugal into engagement with the protruded block of said first transmission gear, for enabling the driving power of said engine to be directly transmitted through said drive gear, said driven gear, and said first transmission gear to said output shaft; when the speed of revolution of said output shaft drops below said predetermined level, said clutch is disengaged from the protruded block of said first transmission gear for enabling the driving power of said engine to be transmitted through said drive gear, said driven gear, said first transmission gear, said idle gear wheel, said second transmission gear, and said one-way axle bearing to said output shaft.

2. The dual-gearshift position transmission mechanism for remote control toy car of claim 1 wherein said clutch comprises an oscillating member pivoted to a base thereof and moved between a first position where said clutch is disengaged from the protruded block of said first transmission gear and a second position where said clutch is forced into engagement with the protruded block of said first transmission gear, a stop element stopped against one end of said oscillating member to hold said oscillating member in said first position, and a spring connected between said base and said stop element to force said stop element against said oscillating member.

* * * * *